US005163799A

United States Patent [19]

Lynn

[11] Patent Number: 5,163,799

[45] Date of Patent: Nov. 17, 1992

[54] WALL PANEL LIFTING AND SUPPORTING DEVICE

[76] Inventor: Mitchel W. Lynn, R.D. #2, Box 234, Martinsburg, Pa. 16662

[21] Appl. No.: 732,106

[22] Filed: Jul. 18, 1991

[51] Int. Cl.[5] ..... E04F 21/18

[52] U.S. Cl. ..... 414/11; 248/351

[58] Field of Search ..... 248/228, 235, 351; 414/11

[56] References Cited

U.S. PATENT DOCUMENTS

| | | | |
|---|---|---|---|
| 2,741,514 | 4/1956 | Fisher | 414/11 |
| 3,642,150 | 2/1972 | Zizak | 414/11 |
| 3,910,421 | 10/1975 | Panneton | 414/11 |

*Primary Examiner*—Michael S. Huppert
*Assistant Examiner*—Janice Krizek
*Attorney, Agent, or Firm*—Jacobson, Price, Holman & Stern

[57] ABSTRACT

The panel lifting and supporting device includes a head piece attached to building framing members with a pair of brackets pivotally attached thereto with the brackets receiving elongated 2" by 4" wood members or other similar elongated members which can pivot from an inclined position in relation to a ceiling or wall to enable a panel to be placed thereon and the free ends of the elongated members then can be elevated and a prop used to support the swingable free ends of the elongated members in a position adjacent the building framing members. Brackets are attached to the outer ends of the elongated members and are interconnected by a handle structure with the prop being provided with a bracket detachably connected to the handle structure to support it in elevated position. The headpiece includes structural features enabling it to be connected with and supported from various building framing members to provide versatility in use.

6 Claims, 1 Drawing Sheet

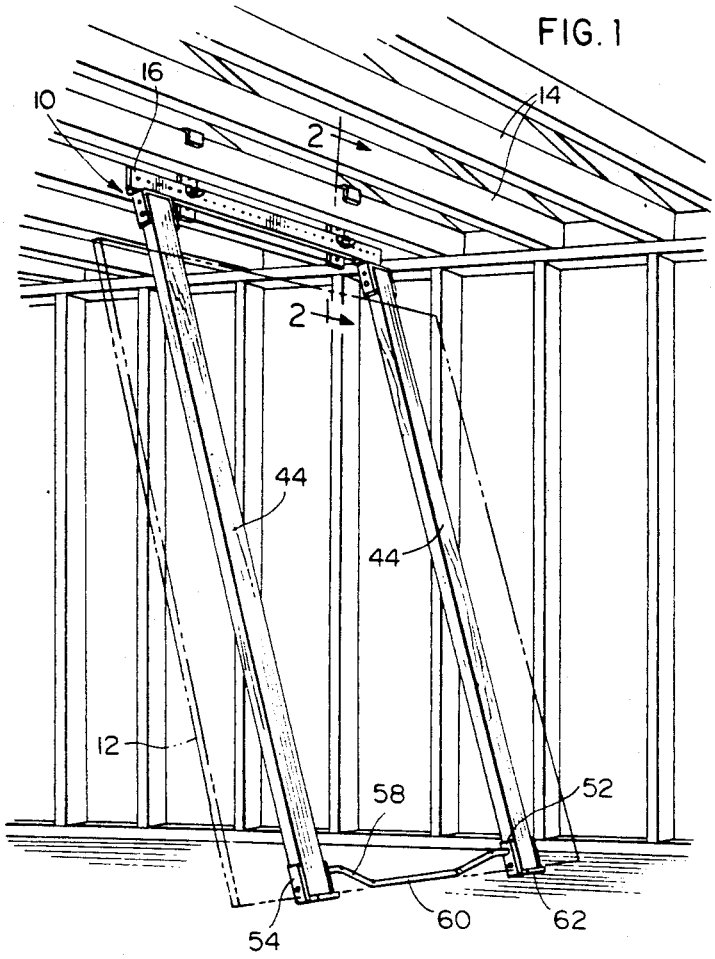
FIG. 1
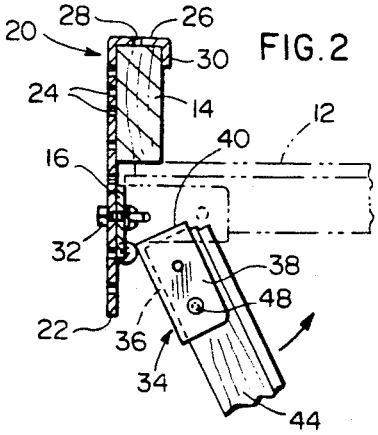
FIG. 2
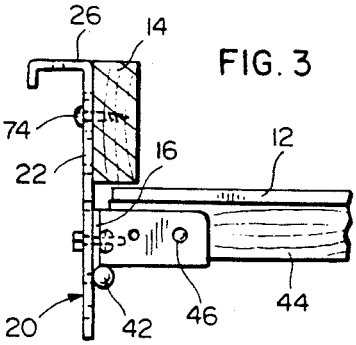
FIG. 3
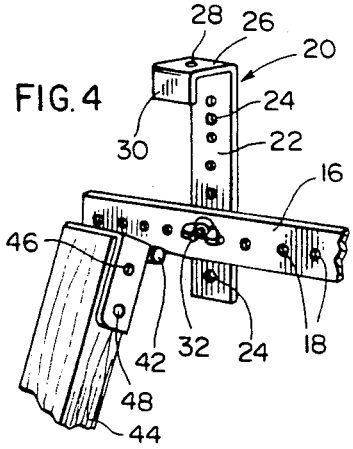
FIG. 4
FIG. 9
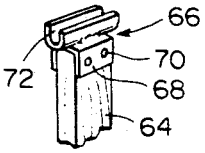
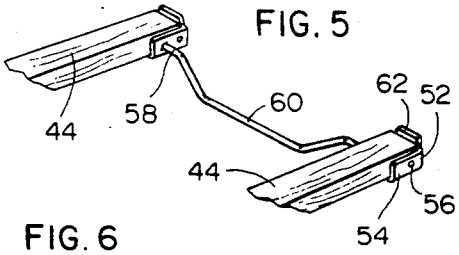
FIG. 5
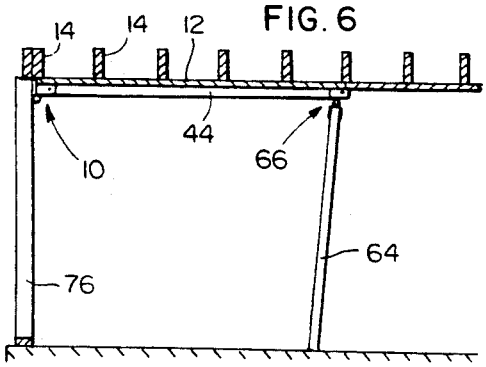
FIG. 6
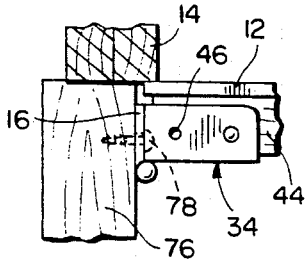
FIG. 7
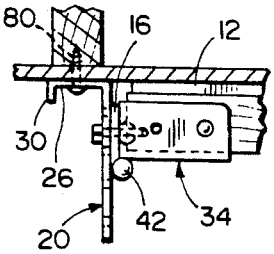
FIG. 8

WALL PANEL LIFTING AND SUPPORTING DEVICE

BACKGROUND OF THE INVENTION

1. Field of the Invention

The present invention generally relates to a device for assisting in lifting and supporting a wall or ceiling panel in an elevated position to enable such panels to be accurately positioned and held in place while being secured to supporting joists, rafters, studs or the framing members used in building structures. The panel lifting and supporting device includes a head piece attached to building framing members with a pair of brackets pivotally attached thereto with the brackets receiving elongated 2" by 4" wood members or other similar elongated members which can pivot from an inclined position in relation to a ceiling or wall to enable a panel to be placed thereon and the free ends of the elongated members then can be elevated and a prop used to support the swingable free ends of the elongated members in a position adjacent the building framing members. Brackets are attached to the outer ends of the elongated members and are interconnected by a handle structure with the prop being provided with a bracket detachably connected to the handle structure to support it in elevated position. The headpiece includes structural features enabling it to be connected with and supported from various building framing members to provide versatility in use.

2. Description of the Prior Art

In building structures, ceilings and walls are frequently constructed of a plurality of gypsum panels with such structures generally being referred to as drywall. Also, other panels are used to form wall and ceiling structures in buildings. Panels of this type are usually 4' by 8' and are generally difficult to handle due to their size and weight and some capability of flexing. When installing such panels on a ceiling or wall, it usually is necessary for multiple workmen to be present to support and position the panel while it is being secured in place by appropriate nails or other fastening devices. There have been some efforts to provide devices to lift and support such panels in a desired position while the panels are being secured in place. Such devices include lift devices including vertically movable supporting components which engage the relatively large panel. Other devices include pivotal structures having one end connected to building framing members and the other end swung about a pivot axis to position the panel in desired position. The following U.S. Pat. Nos. are relevant to this invention.

2,371,561
2,741,514
3,642,150
4,867,403

The above patents do not disclose the specific structural arrangements of the above invention including the multiple arrangements for attaching a headpiece to the building framing members, the specific relationship and structure of the brackets attached to the headpiece and the specific relationship and structure of the handle, brackets connecting the handle to the elongated members and the connection between the prop and handle.

SUMMARY OF THE INVENTION

An object of the present invention is to provide a versatile, portable, relatively lightweight and inexpensive ceiling or wall panel lifting and supporting device to facilitate a single workman lifting, positioning and fastening wallboard or other panels to a supporting structure such as overhead ceiling joists, rafters and the like.

Another object of the invention is to provide a panel lifting and supporting device which includes an elongated headpiece in the form of a rigid member having length slightly greater than the width of panels to be lifted and supported an including bracket structures enabling it to be effectively supported from various types of building framing members.

A further object of the invention is to provide a panel lifting and supporting device in accordance with the preceding objects in which the headpiece includes pivotal brackets supportingly engaging a pair of elongated 2" by 4" wooden members or the like with the ends of the elongated members remote from the headpiece being vertically swingable and provided with brackets interconnected by a handle with an offset to facilitate the elongated members being lifted from an incline position to an elevated position with a wall panel positioned on the elongated members being lifted to the elevated position at the same time.

Still another object of the invention is to provide a panel lifting and supporting device in accordance with the preceding objects in which the handle is supported in an elevated position by a prop having a bracket at the end thereof engaged with the handle to support the panel in elevated position while it is being fastened to an overhead support.

These together with other objects and advantages which will become subsequently apparent reside in the details of construction and operation as more fully hereinafter described and claimed, reference being had to the accompanying drawings forming a part hereof, wherein like numerals refer to the like parts throughout.

BRIEF DESCRIPTION OF THE DRAWINGS

FIG. 1 is a perspective view of the wall panel lifting and supporting device of the present invention illustrating it in an inclined position to receive a wallboard or other panel thereon.

FIG. 2 is a vertical sectional view, on an enlarged scale, taken substantially upon a plane passing along section line 2—2 on FIG. 1 illustrating one manner of attaching the headpiece to an overhead support.

FIG. 3 is a sectional view similar to FIG. 2 but illustrating a different manner of attachment of the headpiece.

FIG. 4 is a fragmental perspective view of one end of the headpiece, the mounting bracket attached thereto and the pivotal bracket to support one end of an elongated wooden member.

FIG. 5 is a perspective view of the handle structure attached to the swingable ends of the elongated members.

FIG. 6 is a side elevational view illustrating the wall panel lifting and supporting device in elevated position and retained in that position by a prop structure.

FIG. 7 is a fragmental elevational view illustrating the manner of attaching a headpiece directly to vertical studs adjacent the ceiling of a building.

FIG. 8 is a fragmental elevational view illustrating a fourth manner of attaching the headpiece to a support.

FIG. 9 is a perspective view illustrating the bracket interconnecting the upper end of the prop and the offset central portion of the handle extending between the swingable ends of the elongated wooden members.

DESCRIPTION OF THE PREFERRED EMBODIMENTS

Referring now specifically to the drawings, the panel lifting and supporting device of the present invention is generally designated by reference numeral 10 and is especially adapted for supporting a ceiling wallboard panel 12 in a horizontal elevated position while it is being secured to overhead supporting building frame members such as ceiling joists or rafters 14. The lifting and supporting device 10 is especially useful in supporting gypsum wallboard when installing drywall.

The lifting and supporting device 10 includes an elongated rigid headpiece 16 in the form of an elongated rigid metal bar or strap having a plurality of longitudinally spaced apertures 18 along the center line thereof. A pair of mounting brackets 20 are attached to the headpiece 16 with each mounting bracket including a vertical member 22 having a plurality of longitudinally spaced apertures 24 therein. The upper end of the vertical member 22 is provided with a horizontal member 26 having a centrally disposed aperture 28 therein and the free edge of the horizontal member 26 is provided with a downturned flange 30 so that the mounting brackets 20 are, in effect inverted L-shaped members with the vertical member 22 being removably and adjustably attached to the headpiece 16 by a bolt and wing nut arrangement 32.

Each end of the headpiece 16 is also provided with a supporting bracket generally designated by numeral 34 including a short bottom wall portion 36, a pair of parallel sidewalls 38 and an end wall 40. The juncture between the bottom wall 38 and the end wall 40 is provided with a hinge structure 42 that pivotally connects the supporting bracket 34 to the headpiece 16. The dimensions of the bracket 30 are such as to receive the end of a 2" by 4" wooden member 44 of elongated construction with the flanges 38 including apertures 46 receiving nails or other fastening devices 48 to secure the end of the elongated member 44 to the supporting bracket 34 to enable pivotal movement of the elongated members 44 in relation to the headpiece 16. This structure enables the elongated members 44 to be pivoted from the inclined position illustrated in FIG. 1 to a horizontal elevated position illustrated in FIG. 6.

The ends of the elongated wooden members 44 remote from the headpiece 16 include a handle structure generally designated by reference numeral 50 which includes a pair of brackets 52 similar to the brackets 34 with side flanges 54 including at least one opening 56 receiving a fastener to secure the brackets to the wooden members 44. A handle forming rod 58 rigidly interconnects the brackets 52 and includes a downwardly offset central portion 60 which forms a handle to enable the person using the device to grasp the handle 60 and lift the free ends of the members 44 and the wallboard 12 thereon upwardly from the inclined position of FIG. 1 to the position of FIG. 6. The upper edge of the end flanges on the bracket 52 includes a projecting flange 62 which cooperate to form a supporting ledge for the bottom edge of the wallboard 12 when it is in the inclined position illustrated in FIG. 1 and to retain the wallboard on the elongated members 44 as the elongated members are being lifted. When the elongated members and the wallboard thereon have been lifted to a generally horizontal position, a prop 64 in the form of an elongated wooden 2" by 4" member is positioned in a manner to support the handle structure 50. A bracket 66 is mounted on the upper end of the prop 64 and includes spaced flanges 68 receiving fasteners 70 to secure the channel-shaped member to the prop 64. Rigidly mounted on the web of the channel-shaped bracket 66 is a generally U-shaped saddle 72 which has a dimension to receive the offset central handle 60 thus forming an interconnection between the upper end of the prop 64 and the handle structure 50 with the offset central portion of the handle structure 50 positioning the saddle 72 generally in the central area of the handle structure 50. Thus, when the handle structure 50 is lifted along with the swinging ends of the elongated members 44 and the wallboard 12, the prop is positioned by engaging the saddle 72 with the offset central handle 60 to support the wallboard 12 in position against the ceiling or other overhead or wall support and this enables a single workman to position the wallboard lift it to a desired position and prop it in position so that the workman can then fasten the wallboard in place by using nails or similar fastening arrangements.

FIG. 2 illustrates one manner of supporting the headpiece from an overhead joist or rafter in which the inverted L-shaped or hook-shaped member is positioned s that the flange 26 overlies the upper surface of the rafter and the flange 30 engages the surface of the rafter or joist opposite to the vertical member 22. The fastening bolt 32 is used to adjust the position of the supporting brackets 34 so that the wallboard 12 will be properly positioned in relation to the overhead supporting structure.

FIG. 3 illustrates another arrangement in which the bracket 20 is arranged so that it is positioned alongside of the overhead supporting joist or rafter with the flanges 26 and 28 extending away from the joist or rafter and a fastening device in the form of a screw or bolt 74 secures the vertical member 22 to the surface of the joist or rafter. This arrangement is used when the upper surface of the joist or rafter is provided with another building framing component or the like thus enhancing the manner of connecting the headpiece to the supporting joist or rafter with the bracket 20 positioned in various relationships to the joist or rafter 14.

FIG. 7 illustrates another manner of supporting the headpiece 16 which, in this instance, is attached directly to vertical studs 76 which support overhead joists or rafters 14. In this arrangement, brackets 20 are not used and fastening screws or bolts 78 are inserted directly through the holes 18 on the headpiece and into the stud 76 adjacent the upper ends thereof.

FIG. 8 illustrates another arrangement in which the bracket 20 is lowered in relation to head piece 16 and the flange 26 is positioned under the joist 14 and a fastener 80 extends vertically upwardly through the central aperture 28 into the supporting joist or other framing member 14. The structure of the headpiece and the relationship of the brackets 20 thereto provide various installational capabilities which adapt the panel lifting and supporting device 10 to use with various arrangements of building framing members.

The headpiece 16, brackets 20, brackets 34, handle structure 50 and brackets 66 are of rigid metal construction and the elongated wooden members 44 and the prop 64 are readily available 2" by 4" members with the members 44 being preferably 8' or more in length and the prop 64 will be of adequate length to support the members 44 and the wallboard 12 in a position against the supporting structures to which the wallboard will be attached. The device 10 is a relatively inexpensive and lightweight, portable and easily used lift and supporting device which enables a single workman to more easily install wallboard, gypsum panels and the like by enabling such panels to be accurately positioned and supported while being secured to the overhead support.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A wall panel lifting and supporting device comprising an elongated rigid headpiece, means supporting the headpiece from an elevated support structure, a bracket adjacent each end of the headpiece, means pivotally connecting the brackets to the headpiece, an elongated member attached to each of said brackets, a handle structure interconnecting the ends of the elongated members remote from the brackets to enable the elongated members to be lifted from a generally inclined position with a wall panel positioned thereon to a generally horizontal position to orient the wall panel in an elevated position while being attached to a supporting structure, and prop means engaged with the handle structure for retaining the handle structure and the ends of the elongated members in an elevated position, said handle structure including a pair of bracket members attached to the end of the elongated members remote from the headpiece brackets, a rigid handle rod interconnecting said bracket members and including a central offset portion forming a handle to be gripped for lifting the remote ends of the elongated members, said prop means including an elongated prop, and means connecting the elongated prop to the handle structure including a bracket attached to the upper end of the elongated prop the bracket on the elongated prop including an upwardly opening generally U-shaped saddle to receive the central offset portion of the handle structure.

2. A wall panel lifting and supporting device comprising an elongated rigid headpiece, means supporting the headpiece from an elevated support structure, a bracket adjacent each end of the headpiece, means pivotally connecting the brackets to the headpiece, an elongated member attached to each of said brackets, a handle structure interconnecting the ends of the elongated members remote from the brackets to enable the elongated members to be lifted from a generally inclined position with a wall panel positioned thereon to a generally horizontal position to orient the wall panel in an elevated position while being attached to a supporting structure, and prop means engaged with the handle structure for retaining the handle structure and the ends of the elongated members in an elevated position, said means supporting the headpiece from a structure including an inverted L-shaped mounting bracket adjacent each end of the headpiece, each mounting bracket including a horizontal leg and a vertical leg having a plurality of apertures therein depending from the horizontal leg to enable the vertical position of the mounting brackets to be adjusted in relation to the headpiece and to enable the mounting brackets to be mounted on the headpiece with the horizontal leg extending either toward or away from the headpiece, fastening means extending through the headpiece and a selected aperture in each mounting bracket.

3. The structure as defined in claim 2 wherein the horizontal leg of each mounting bracket is positioned in overlying spaced relation to the headpiece for engaging the upper surface of a joist overlying the headpiece.

4. The structure as defined in claim 2 wherein said mounting bracket is positioned with the horizontal leg thereof extending away from the headpiece and being positioned adjacent the upper edge of the headpiece for positioning under the being attached to an overhead joist.

5. The structure as defined in claim 2 wherein said mounting bracket is positioned with the horizontal leg thereof extending away from the headpiece and the vertical leg of the mounting bracket receiving a fastener securing the headpiece to the vertical surface of a joist overlying the headpiece.

6. A panel lifting and supporting device comprising an elongated horizontally disposed rigid headpiece, means supporting the headpiece from an elevated support structure, a bracket adjacent each end of the headpiece, means pivotally connecting each bracket to the headpiece for pivotal movement about an axis at a bottom edge of said headpiece, an elongated member attached to each of said brackets, a handle structure interconnecting the ends of the elongated members remote from the brackets to enable the elongated members to be lifted from a generally inclined position with a panel positioned thereon to a generally horizontal position to orient the panel in an elevated horizontal while being attached to a supporting structure, and drop means engaged with the handle structure for retaining the handle structure and the ends of the elongated members in an elevated position, said means supporting the headpiece from a support structure including fasteners securing the headpiece to the upper end portions of vertical studs adjacent a ceiling structure, said headpiece being in the form of a rigid bar having a plurality of longitudinally spaced apertures for receiving said fasteners and enabling said fasteners to extend into the studs regardless of the stud spacing, the surface of the bar facing the studs being planar to engage the studs over the complete vertical extent of said bar, said bar being spaced below the ceiling structure to enable an edge of the panel being lifted and supported to be positioned horizontally against a ceiling structure when supported by said device.

* * * * *